United States Patent [19]

Lower

[11] 4,069,146

[45] Jan. 17, 1978

[54] DISTRIBUTION OF FEED ONTO A SCREENING MACHINE

[75] Inventor: William E. Lower, Cincinnati, Ohio

[73] Assignee: Rotex, Inc., Cincinnati, Ohio

[21] Appl. No.: 697,317

[22] Filed: June 18, 1976

[51] Int. Cl.[2] ..... B07B 1/04

[52] U.S. Cl. ..... 209/254

[58] Field of Search ..... 209/148, 150, 153, 243, 209/254, 264, 266, 278, 281, 283, 315, 317, 332, 355, 497, 498; 210/405; 55/474; 222/410

[56] References Cited

U.S. PATENT DOCUMENTS

| | | | |
|---|---|---|---|
| 690,777 | 1/1902 | Schiller | 209/243 |
| 1,100,649 | 6/1914 | Bennett et al. | 209/498 |
| 2,012,726 | 8/1935 | Minogue | 209/254 |
| 2,938,627 | 5/1960 | Hobart | 209/498 |
| 3,720,316 | 3/1973 | Riesbeck et al. | 209/254 |
| 3,779,381 | 12/1973 | Armstrong | 209/315 |
| 3,819,050 | 6/1974 | Lower | 209/254 |
| 3,899,417 | 8/1975 | Morris | 209/243 |

FOREIGN PATENT DOCUMENTS

| | | | |
|---|---|---|---|
| 125,386 | 9/1947 | Australia | 209/318 |
| 948,444 | 2/1964 | United Kingdom | 222/410 |
| 184,870 | 8/1922 | United Kingdom | 209/148 |
| 178,217 | 11/1966 | U.S.S.R. | 209/254 |

*Primary Examiner*—Frank W. Lutter
*Assistant Examiner*—David L. Lacey
*Attorney, Agent, or Firm*—Wood, Herron & Evans

[57] ABSTRACT

A method and apparatus for improving the distribution of a stream of incoming feed material onto the screen of a screening machine. The distributor apparatus includes a rotating, dished or cupped thrower surrounded by a fixed shroud. The shroud is of a cross-sectional area substantially larger than that of the thrower but substantially less than the surface area of the screening machine's top screen. The incoming material is discharged into the cup of the thrower, the rotation of which slings the material outwardly over the rim of the cup and against the shroud, in a more symmetrical angular distribution. A roof having directional vanes on it is interposed above the screening machine's top screen, and below the thrower and shroud. The infed material drops from the shroud onto the vaned roof, and the vanes direct it outwardly in a predetermined pattern toward the peripheral edges of the screening machine's top screen. Distribution asymmetries that would otherwise result from surges in the feed rate and/or off-center discharge of the infed material are minimized, and a higher throughput of infed material is achieved.

14 Claims, 8 Drawing Figures

DISTRIBUTION OF FEED ONTO A SCREENING MACHINE

This invention relates to screening machines. More particularly, this invention relates to an improved distributor for a screening machine of the type having horizontal or slightly tilted screens.

If no provision is made for distributing the particulate infed stream evenly on such screening machines, the particles may flow poorly or unevenly from the point of feed, so that only a portion of the screen surface is effectively used. This can result in substantial inefficiency for the screening machine, and thereby reduce capacity.

One type of feed distrbutor aimed at solving this problem is disclosed in Lower U.S. Pat. No. 3,819,050, assigned to the same assignee as this. The distributor disclosed in that patent basically includes a central rotating thrower presenting a tilted or angulated plate which receives the infed stream on its angulated surface and, by its rotation, throws or scatters the infed stream outward over a roof having multiple direction baffles or vanes on it. In the machine there illustrated, the vanes direct the feed toward the edges of the screening machine in a relatively efficient and even distrbution manner.

Although the distributor taught in that patent has met with commercial success, its effectiveness is reduced if the infed stream is off-center with respect to the tilted plate of the thrower, or if the infed stream has any horizontal velocity component. If the infed stream is discharged onto the plate substantially off-center, rather than at the center, or if it has a horizontal velocity, it is scattered unevenly in the circumferential direction, thereby reducing the symmetry of the distribution over the screening machine. This may occur for example, where the infeed is delivered by a conveyor at an uneven rate, or in clumps, or where it falls at an angle to vertical. Even use of a funnel or hopper to feed the thrower does not necessarily eliminate the problem.

In machines of the type shown in U.S. Pat. No. 3,819,050, the throughput is limited to an extent by the feed distributor structure itself. The higher the rotational speed of the thrower plate, the farther the particulate infed material is thrown toward the side edges of the screening machine. Above some maximum speed, the thrower scatters particulate material over the side of the screening machine, i.e., out of operational contact with the screens. This, of course, limits the throughput to the machine, and it can present a housekeeping problem as well.

Accordingly, it has been the major objective of this invention to provide an improved feed distributor for a screening machine, structured to overcome the effect of surges of unevenness in the infeed flow rate or in the direction of fall of the stream.

In accord with this objective, the improved feed distributor of this invention includes a rotatable, cup or dish-shaped thrower, surrounded by a fixed shroud. The shroud is of a cross-sectional area substantially larger than that of the thrower, but sbstantially less than the surface area of the screening machine's top screen. Incoming material is directed into the concave thrower but not necessarily axially and not necessarily vertically. The thrower slings the material outwadly over its rim, against the shroud. A roof having directional vanes thereon is interposed between the screening machine's top screen, and the thrower and shroud. The infed material drops from the shroud onto the vaned roof, that roof's vanes directing same outwardly toward the peripheral edges of the screening machine's top screen. It has been found that this structure is much less sensitive to off-center feed streams, to angulated (rather than vertical) stream feed directions, and to feed surges or rate changes, than the previous thrower. It also permits a higher throughput of infed material than previously.

Other objectives and advantages will be more apparent from the following detailed description taken in conjunction with the drawings in which.

The improved feed distributor 10 of the invention for a screening machine 11 is shown for purposes of example in combination with a high capacity chip screener 12. The screener 12 is suspended for vibratory movement on rods or cables 13 suspended from an overhead framework, not shown. The screener 12 itself comprises no part of the invention, and may be of any type known to the prior art. By way of example, the screener 12 basically illustrated in the figures may be that shown in Lower U.S. Pat. No. 3,819,050.

Figure 1:
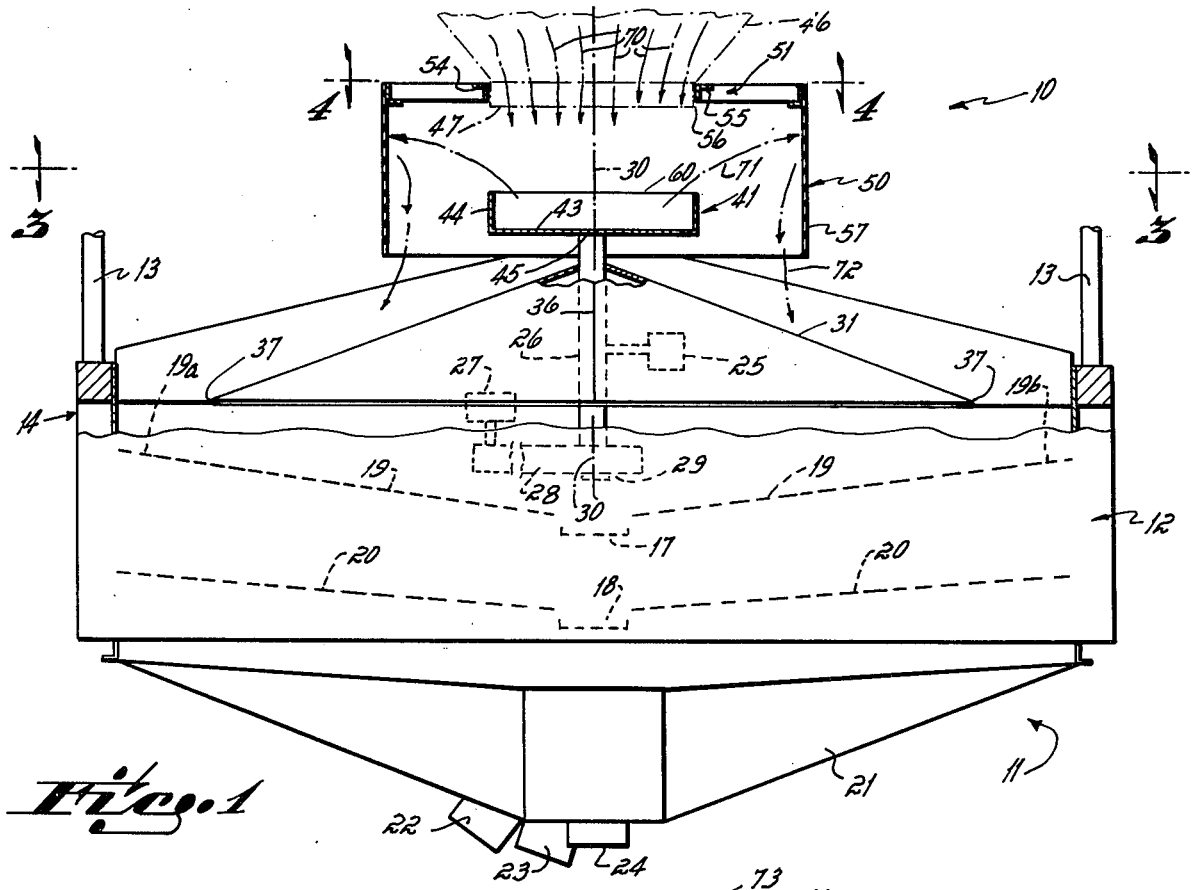
FIG. 1 is an end view, partially broken away, of a screening machine equipped with a preferred form of feed distributor structured in accord with the principles of this invention, the distributor being shown somewhat diagrammatically in operation.

The screening machine 11 includes a generally rectangular frame or screen box 14 which carries an upper screen deck 19 and a lower screen deck 20, see FIG. 1. The screen decks 19, 20 are angulated downwadly toward the center of the machine's frame 14 so as to deliver oversized material retained on same into central troughs 17, 18, respectively. Each of the screen decks 19, 20 is of a generally similar construction, except that top screen 19 is of a larger mesh than bottom screen 20. In use, the infed material stream is directed into the top screen 19 by the improved feed distributor 10 of this invention. Smaller size particles pass through that screen 19 while the larger size material is retained on the screen 19. That material passing through the top screen 19 falls onto the bottom screen 20 where the intermediate size material is retained on the screen 20 while the even smaller size material passes through that screen 20 onto floor 21 of the screener 12. While the screener 12 is in operation, the particulate material retained on the top screen 19 will flow downwardly to central trough 17, and will be delivered by it to a first chute 22. Particulate material passing through the top screen 19 but retained on the bottom screen 20 is delivered through trough 18 to a second output chute 23. Particulate material which passes through the bottom screen 20 drops onto the floor 21 and is delivered to yet a third chute 24. The chutes 22–24 may be typically connected to silos or collection bins by conduits not shown.

Vibratory motion is imparted to the screener 12 by an eccentric weight 25 fixed in place outwardly from vertical shaft 26. An electric motor 27, connected to the shaft through belt 28 and drive pulley 29, serves as the drive means to rotate the shaft 26 and, hence, the eccentric weight 25. The shaft 26 is centrally, i.e., coaxially, located relative to the axis 30 of the screening machine frame 14. As motor 27 drives or rotates the eccentric weight 25, vibratory screening motion is induced into the screens 19, 20 and machine frame 14.

Figure 3:
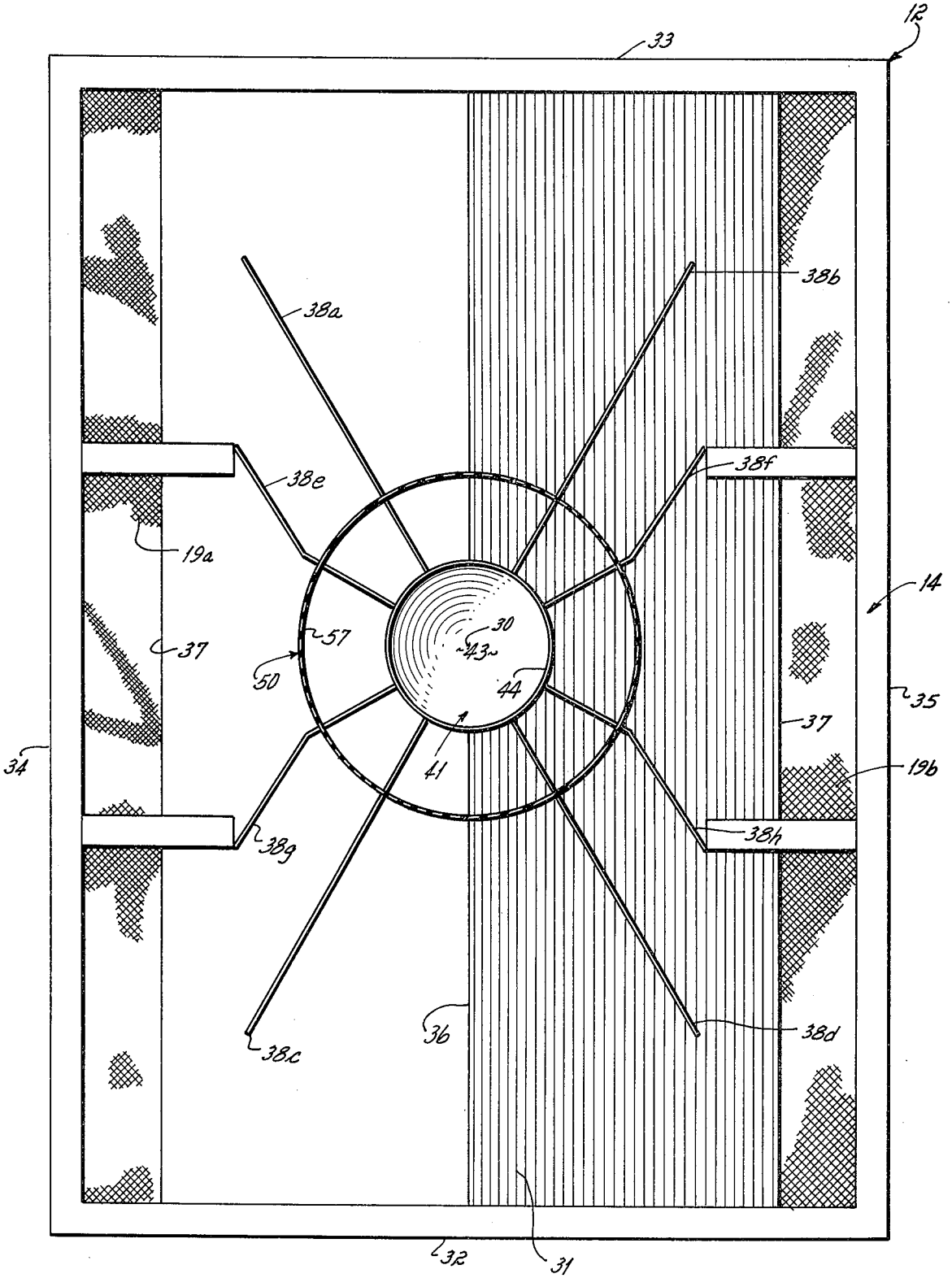
FIG. 3 is a top view of the screening machine shown in FIG. 1, taken on line 3—3 of FIG. 1.

A roof or distributor panel 31, which for the machine shown is rectangular in plan in accord with the rectangular frame 14, is fixed in place above the top screen 19, see FIGS. 1 and 3. The roof panel 31 extends from end 32 to end 33 of the machine's frame 14, i.e., longitudinally of the frame 14, but terminates inwardly of each side edge 34, 35, thereby exposing outer peripheral or side edge portions **19*a* and 19*b* of the top screen 19, 19 when viewed from above as seen in FIG. 3. The roof or distributor panel 31 is in the form of an inverted V, and has a ridge line 36 which is parallel to the roof edges 37 and which extends through the screener's center axis 30. A series of fixed baffles or vanes 38 are mounted atop the roof panel 31, those vanes extending outwardly toward the roof's side edges 37 from the screener's center axis 30**.

In the machine illustrated, the vanes 38 are positioned on the roof panel 31 to divide the infed material that falls onto the roof into substantially equal fractions (the number of fractions being dependent on the number of vanes), and to direct those fractions to the periheral side edges **19*a*, 19*b*of the top screen 19 so that the flow rate of infed material throughout the top screen area is substantially the same. It is this objective which determines the angles between the vanes 38, and the position of the vanes on the roof panel 31. In other words, the vanes 38 are disposed on the roof 31 such that the flow pattern of the infed material falling from the roof onto the top screen 19 will do so at a substantially uniform rate for all areas of the screen within side edge portions 19*a*, 19*b* thereof. Thus, the vanes 38, in combination with the roof 31 itself, direct the infed material downwardly and outwardly to the marginal or side edge portions 19*a*, 19*b* of the top screen 19, 19** after that infeed has been distributed onto the roof.

Figure 2:
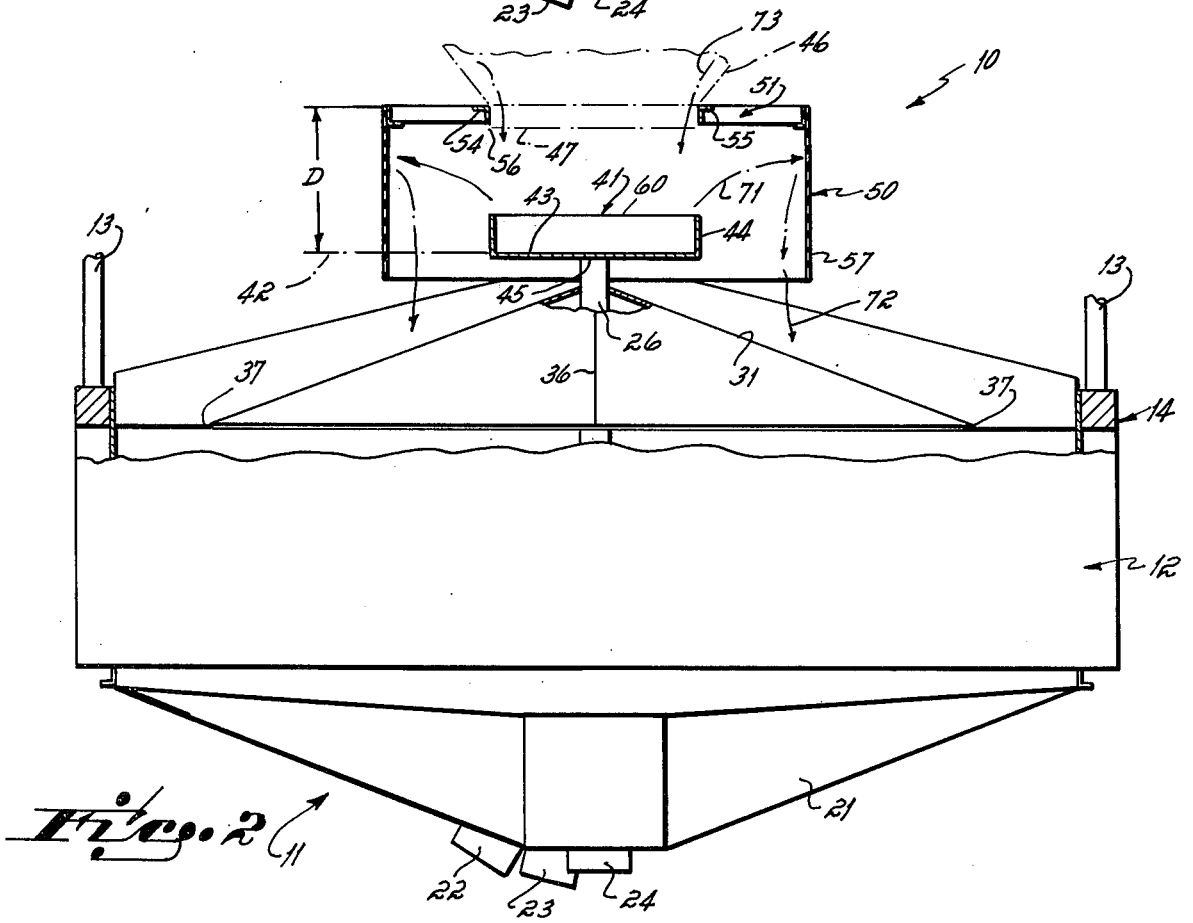
FIG. 2 is a view similar to FIG. 1 but showing operation of the distributor with an off-center feed stream.
Figure 4:
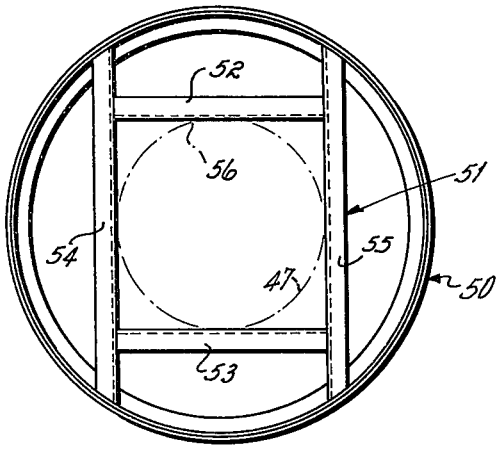
FIG. 4 is a top view of the shroud of the distributor illustrated in FIGS. 1 and 2, and taken along line 4—4 of FIG. 1.
Figure 6:
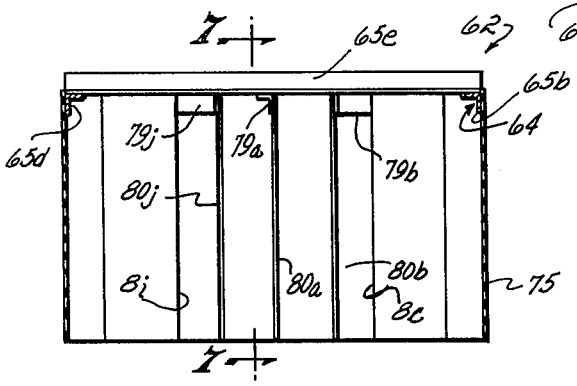
FIG. 6 is a vertical cross-section taken along line 6—6 of FIG. 5.
Figure 5:
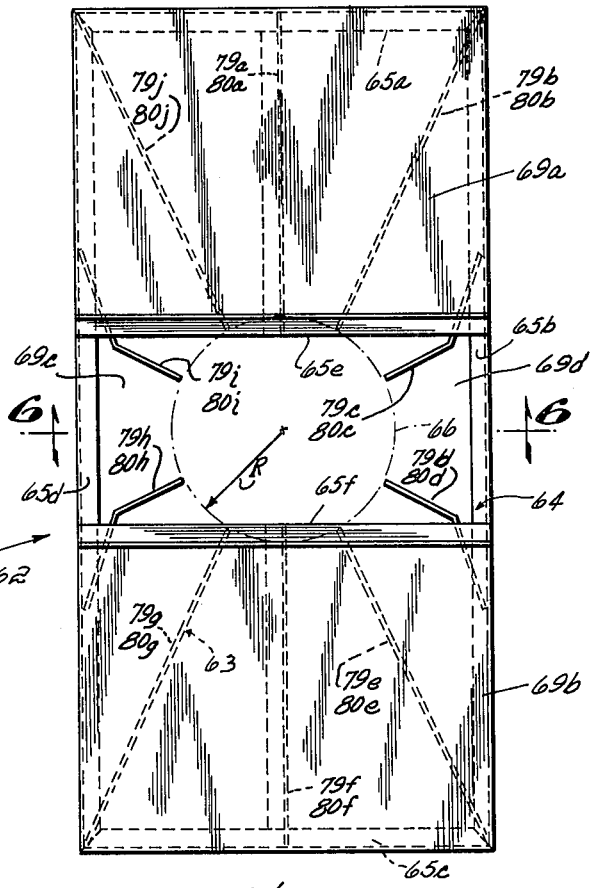
FIG. 5 is a top view of a second embodiment of the shroud of the distributor.
Figure 7:
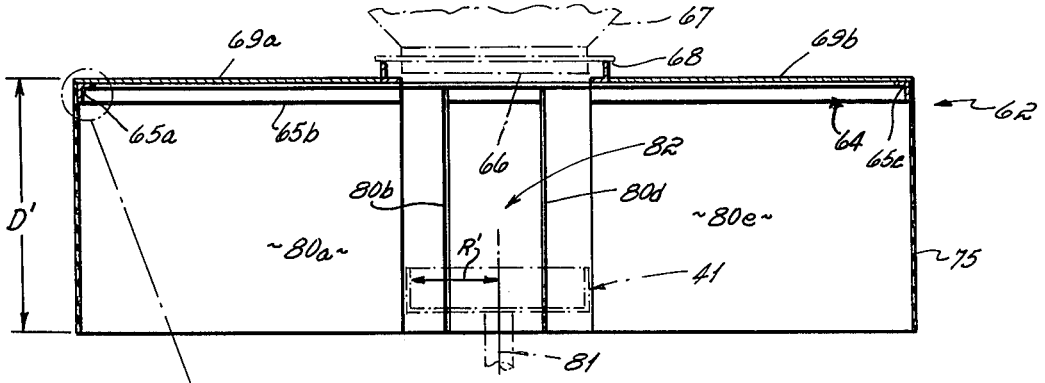
FIG. 7 is a vertical cross-section taken along line 7—7 of FIG. 6.

One embodiment of the improved distributor 10 of this invention is particularly illustrated in FIGS. 1–4, and a second embodiment is illustrated in FIGS. 5–7. As shown in FIGS. 1 and 2, the improved distributor 10 includes a cup-or dish-shaped concave plate or thrower 41 fixed in place on the center shaft 26 as at 45, and disposed in a horizontal plane 42 relative to ground, that plane being normal to center axis 30 of the screener 12. The plate 41 is comrised of a horizontal and circular floor member 43 and a peripheral cylindrical wall member 44, the concave plate opening upwards and being coaxially aligned with the axis 30 of the screener 12. A feed hopper or funnel 46 may be positioned above, and is disposed coaxially with, the thrower 41. The funnel 46 may be fixed to support structure, not shown, and is fed with infed material from a source, not shown. However, it should be understood that the use of a funnel is not required and that the feed stream 70 or 73 may be discharged into the thrower directly rom a conveyor. When the funnel's mouth 47 and the thrower 41 are both of circular cross-section, preferably the cross-sectional area of each is about the same as that of the other, as illustrated in FIGS. 1 and 2.

A tubular (cylindrical) shroud 50 preferably of circular cross-section is mounted around the thrower 41. If a funnel is used, the shroud may be mounted to the bottom or mouth 47 end thereof, see FIGS. 1 and 4. As illustrated in the figures, the shroud 50 is concentrically disposed relative to the thrower 41. The shroud 50, which is a part of the structural combination comprising the improved feed distributor 10, includes a framework 51 fabricated of elements 52–55, see FIG. 4. The framework 51 is structurally rigid, and may be fixed to the feed hopper's mouth 47 as at 56 such as by tack welding, bolts, or the like, thereby locating the shroud 50 in fixed relation with the funnel 46. Note particularly, as shown in FIGS. 1 and 2, that the shroud 50 includes a cylindrical side wall 57, peferably of depth D sufficient to enclose that space between the funnel's mouth 47 and the thrower's floor 43. The side wall 57 is fixed to the outer periphery of the framework 51 by bolts 58 and a retainer plate 59, see FIG. 8. Preferably the tubular side wall 57 of the shroud 50 will be flexible, and will be fabricated of a noise dampening material. Sheet rubber or the like is suitable, and particles thrown against it will be less likely to be broken. Also preferably, and as illustrated in the Figures, the cross-sectional area of the shroud 50 is at least about two times the cross-sectional area of the concave thrower. However, it is also preferable that the shroud's cross-sectional area be substantially less than the top surface area of the vaned roof 31. In the case of a shroud 50 having a circular cross-section as shown in FIGS. 1 and 4, and in the case of a circular thrower 41, a shroud 50 diameter about twice as great as the thrower's diameter has been found to give good results. On each side of the roof's ridge line 36 and with respect to the size of the shroud 50 as shown in FIG. 3, note that the vanes 38 extend radially outward from the screen's axis 30 until same clear the shroud's peripheral wall 57. Once outside the shroud's periphery, certain **38*a*–38*d* of the vanes continue directly and radially toward the corners of the screener 12, and others 38*e*–3*h*** angle off therefrom also toward the corners of the screener.

To achieve very high capacity, it is desirable to provide the shroud with the same general peripheral configuration or geometry as that of the screener's screens 19, 20 and framework 14. In other words, a still higher capacity can be obtained by use of a rectangular shroud with the rectangular screens shown. However, a screening machine 11 using rectangular screens 19, 20 may use a shroud 50 having a circular cross section as illustrated in the FIGS. 1–4, where capacity is adequate. Furthermore, and under certain operational conditions, it may be desirable to provide baffles within the shroud structure itself.

Figure 8:
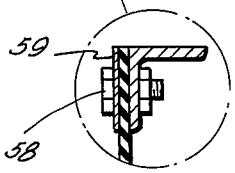
FIG. 8 is an enlarged view of the encircled area of FIG. 7.

A second embodiment illustrating a shroud 62 of generally rectangular configuration, and illustrating baffles 63 in mechanical assembly with the shroud 62 itself, is illustrated in FIGS. 5–8. As shown in those figures, and with reference to the screener 12 illustrated in FIG. 3, the shroud 62 is of a generally rectangular cross section. The shroud includes a framework 64 fabricated of elements **65*a*–65*f*, see FIG. 5. The framework 64 is structurally rigid, and is adapted to be fixed to mouth 66 of a funnel 67, as at 68, such as by welding, bolts, or the like, thereby locating the shroud 62 in fixed relation with the funnel, all as shown in FIG. 7. The rectangular shroud 62 further includes cover or sealing panels 69***a* and 69*b*, and panels (not shown) which are shaped to size and configuration in installation to cover the areas 69*c* and 69*d*. These areas of course do not exist in the case of a rectangular hopper. The shroud illustrated in FIGS. 5–7 is tubular and is, in effect, of a downwardly opening cup configuration. The rectangular shroud 62 includes a tubular (i.e., right cylindrical) side wall of depth D' sufficient to enclose the space between the funnel's mouth 66 and the thrower 41. As with the circular shroud 50, the rectangular shroud's side walls are preferably flexible, and are preferably fabricated of a noise dampening material such as rubber sheeting. The side walls 75 of the shroud 62 are fixed to the outer periphery of framework 64 as by bolts 58 and retainer plates 59, as illustrated in FIG. 8.

The rectangular shroud 62 also includes interior baffles 80 fixed to baffle framework elements 79*a*–79*j*, these baffle framework elements being rigidly connected with the shroud framework elements 65*a*–65*f*. The baffle framework elements 79*a*–79*j* are connected in asymmetrical fashion to the shroud's framework 64 in a manner which corresponds with the vanes 38 on the vane roof 31. In other words, and when viewed from the top as illustrated in FIGS. 3 and 5, the baffle support elements 65*a*–65*f* of the shroud 62 overlie the vanes 38 on the roof panel 31. Baffles 80*a*–80*j* are fixed to the baffle support elements 79*a*–79*j* and extend downwardly therefrom a distance D' identical to that of the shroud's side walls 75. The baffles 80*a*–80*j* are fixed to the baffle support elements in a manner identical to that shown in FIG. 8 for side walls 75, and are also preferably fabricated from a flexible material such as rubber sheeting. As shown in FIG. 7, the shroud's baffles 80*a*–80*j* extend from the peripheral framework 65*a*–65*d* inwardly toward the center axis 81 of the shroud 62, but all terminate a substantial radial distance R away from that center axis 81. This radial distance R is only slightly greater than the radius R' of the thrower 41, thereby defining a cylindrical space 81 axially of the shroud 62 within which the thrower 41 is located during use.

FIG. 1 diagrammatically shows operation of the distributor when the feed stream 70 is delivered substantially coaxially or on-center to the thrower cup. The feed material is received in the cupped interior of the thrower, and the rotation of the thrower 41 slings the material outwardly and slightly upwardly over the cup rim. (The thrower may usefully be rotated at a rate of 200 to 280 rpm, but this range is not critical.) The speed of the thrower should in any event be sufficient that a large portion of the feed particles are thrown against the inside wall 57 of the shroud 50 (see phantom arrows 71). The particles drop from the shroud as a uniform annular stream, down onto the vaned roof 31 and flow over the roof to the side edge portions 19*a*, 19*b* of the top screen (see phantom arrows 72). The roof vanes 38 and/or baffles 80 divide this stream into angular segments to provide the desired distribution onto the screen. Rotation of the concave thrower 41 can be at a higher rate than would be possible without the shroud, with no fear of the infed material being thrown over or beyond the top screen 19 of the screening machine 11 since the shroud 50 limits the radial distance which the infed material is thrown. Thus, the slinging of material against the shroud improves the uniformity of distribution onto the vaned roof 31, and also assures a greater throughput rate of the feed material, thereby promoting better efficiency of the screening machine. In the condition wherein the feed stream is on-center with respect to the thrower, the feed distributor 10 improves on the results of that feed distributor illustrated in the Lower U.S. Pat. No. 3,819,050 in that a higher throughput is achieved since the potential problem of overthrowing the sides of that screen 19 onto the floor is eliminated. It is important to note in his connection that the concavity of thrower 41 causes the material to be thrown not just outwardly, but slightly upwardly as well, thereby removing any angulation of the incoming stream, and avoiding its harmful consequence of distribution symmetry.

The functional advantages of the improved feed distributor 10 of this invention are still more pronounced in a second condition, shown in FIG. 2. This second condition contemplates an off-center, non-vertical, or varying infed stream (see phantom arrows 73). This condition is especially likely to arise where no funnel is used, or where the feed is delivered off the end of a belt conveyor, from which it falls in an arc onto the thrower. It is this second condition that provides problems for the distrbutor device disclosed in Lower U.S. Pat. No. 3,819,050, in that it is more likely to cause an imbalance of unsymmetrical distribution of the feed material over the vaned roof. However, with the improved distributor 10 of this invention such an imbalance does not occur because all the feed material, deposited in the cupped thrower, is thrown upwardly and outwardly over the thrower rim against the shroud 50. Variations in direction and velocity of the infed stream 73 are removed by this thrower, in comparison to the angulated thrower plate of the prior art device.

The embodiment of the shroud 62 illustrated in FIGS. 5–7 functions in substantially the same way as that embodiment illustrated in FIG. 1–4 and also provides the advantages above described. However, because of baffles 80*a*–80*j* provided in the shroud, preliminary separation of the infed material is defined by the shroud 62 itself prior to that particulate material dropping from the shroud on the vaned roof 31. This preliminary definition of the discrete fractions of infed particulate matter further aids and enhances, under certain opertional conditions, the unevenness of distribution achieved by the improved feed distributor 10 of this invention.

Having descrbed in detail the preferred embodiments of my invention, what I desire to claim and protect by Letters Patent is:

1. In a screening machine having a screen, an improved feed distributor for distributing infed material over said screen, said improved distributor comprising, a dish-shaped, concave thrower, said thrower mounted above said screen and positioned to receive a falling stream of infed material, a fixed shroud around said thrower, said shroud having a cross-sectional area which is larger than the area of said thrower but smaller than the surface area of said screen, said thrower being mounted for rotation about a generally vertical axis at a rate such that infed material falling onto said thrower is slung outwardly and upwardly from it to impinge against said shroud by rotation of said thrower, means for rotating said thrower about said axis, and a roof positioned above said screen and below said shroud, said roof extending outwardly beyond the shroud so that infed material slung against said shroud drops from said shroud onto said roof, said roof having a peripheral edge from which material dropping onto the roof from said shroud will thereafter drop onto said screen, said roof pesenting a series of vanes extending outwardly toward the peripheral edge thereof, said vanes positioned on said roof to direct material falling onto said roof from said shroud toward said peripheral edge in a predetermined angular distribution, said screen having a portion which lies outwardly of the peripheral edge of the roof so that material falling over said edge drops onto said portion of the screen.

2. An improved distributor as set foth in claim 1, said thrower comprising a horizontal floor member and a peripheral cylindrical wall member fixed to the floor member, thereby forming said dish shape.

3. An improved distributor as set forth in claim 1, said shroud being substantially cylindrical in configuration, said shroud surrounding said thrower inwardly of said peripheral edge of said roof.

4. An improved distributor as set forth in claim 3, the cross-sectional configuration of said shroud being circular.

5. In a screening machine having a screen, an improved feed distributor for distributing infed material over said screen, said improved distributor comprising, a dish-shaped, concave thrower, said thrower mounted above said screen and positioned to receive a falling stream of infed material, a fixed shroud around said thrower, said shroud having a cross-sectional area which is larger than the area of said thrower but smaller than the surface area of said screen, said shroud being substantially cylindrical in configuration, said shroud surrounding said thrower inwardly of said peripheral edge of said roof, said thrower being mounted for rotation about a generally vertical axis at a rate such that infed material falling onto said thrower is slung outwardly from it and against said shroud by rotation of said thrower, means for rotating said thrower about said axis, and a roof positioned above said screen and below said shroud, said roof extending outwardly beyond the shroud so that infed material slung against said shroud drops from it onto said roof, said roof having a peripheral edge from which material on the roof will drop onto said screen, said roof presenting a series of vanes extending outwardly toward the peripheral edge thereof, said vanes positioned on said roof to direct material falling onto said roof from said shroud toward said peripheral edge in a predetermined angular distribution.

6. An improved distributor as set forth in claim 5, said baffles having inner ends defining a central open space within which said thrower is positioned.

7. An improved distributor as set forth in claim 5, further comprising feed means including, a funnel positioned above said thrower, said funnel being substantially coaxially disposed relative to said vertical axis.

8. An improved distributor as set forth in claim 7, said funnel having a mouth having a cross-sectional area substantially equal to the area of said thrower, the funnel's mouth being concentrically disposed above the thrower.

9. An improved distributor as set forth in claim 5, said shroud being partially closed by a ceiling at the top thereof, said ceiling presenting an opening for said falling stream of infed material.

10. An improved distributor as set forth in claim 5, said shroud having side walls fabricated of a flexible and noise-deadening material.

11. An improved distributor as set forth in claim 10, said material being sheet rubber.

12. An improved distributor as set forth in claim 5, further wherein said screen has an outer portion which lies outwardly of the periheral edge of said roof, so that material falls from said roof onto said outer portion of said screen, said vanes being arranged on said roof to direct material falling from said shroud over said roof to said peripheral edge so as to fall on said outer portion of said screen in a desired angular distribution.

13. An improved method of distributing an off-center, non-vertical stream of particulate infed material over the screen of a screening machine, said improved method comprising the steps of discharging said material so that it falls onto a cup-shaped thrower above the screen, rotating said thrower at a rate such that said particles are slung upwardly and outwardly from said thrower, interrupting the travel of the particles thus thrown by the thrower by providing a wall around said thrower on which the particles impinge in flight, said wall causing the particles to drop downwardly as an annular stream, arresting the fall of said particles from said wall by interposing a roof below the wall and over said screen so that said particles fall onto said roof, directing the particles in desired angular directions on said roof, and discharging the particles thus directed from the roof onto the screen.

14. An improved method of distributing particulate infed material over the screen of a screening machine, said improved method comprising the steps of discharging said material so that it falls into a cup-shaped thrower above the screen, rotating said thrower at a rate such that said particles are slung outwardly from said thrower, dividing the material slung outwardly by the thrower into separate angular segments while it is traveling outwardly from the thrower, interrupting the outward travel of the particles thus thrown and divided by providing a wall around said thrower, said wall causing the particles to drop downwardly as an annular stream, arresting the fall of said particles on a roof over said screen, then conducting the particles in said angular segments in desired angular direction over said roof to different areas of said screen so that the infed material is fed to said different areas at rates per unit which are substantially uniform, and discharging the particles thus directed from the roof onto the screen.

* * * * *